US011753706B2

(12) United States Patent
Zhao et al.

(10) Patent No.: US 11,753,706 B2
(45) Date of Patent: Sep. 12, 2023

(54) GRAPHENE- AND IN-SITU NANOPARTICLE-REINFORCED ALUMINUM-BASED COMPOSITE MATERIAL AND PREPARATION METHOD

(71) Applicant: JIANGSU UNIVERSITY, Zhenjiang (CN)

(72) Inventors: Yutao Zhao, Zhenjiang (CN); Gang Chen, Zhenjiang (CN); Chuang Guan, Zhenjiang (CN); Xizhou Kai, Zhenjiang (CN); Wei Qian, Zhenjiang (CN); Luyao Huang, Zhenjiang (CN); Xu Gao, Zhenjiang (CN); Liwei Jin, Zhenjiang (CN)

(73) Assignee: JIANGSU UNIVERSITY, Zhenjiang (CN)

( * ) Notice: Subject to any disclaimer, the term of this patent is extended or adjusted under 35 U.S.C. 154(b) by 0 days.

(21) Appl. No.: 18/008,669

(22) PCT Filed: Feb. 11, 2022

(86) PCT No.: PCT/CN2022/075973

§ 371 (c)(1),
(2) Date: Dec. 7, 2022

(87) PCT Pub. No.: WO2022/127941

PCT Pub. Date: Jun. 23, 2022

(65) Prior Publication Data

US 2023/0193427 A1 Jun. 22, 2023

(30) Foreign Application Priority Data

Dec. 18, 2020 (CN) ..... 202011504174.3

(51) Int. Cl.
*C22C 1/02* (2006.01)
*C22C 21/00* (2006.01)
(Continued)

(52) U.S. Cl.
CPC ..... *C22C 21/00* (2013.01); *C22C 1/026* (2013.01); *C22C 1/101* (2013.01); *C22C 1/1084* (2013.01); *C22C 1/1094* (2013.01); *C22F 1/04* (2013.01)

(58) Field of Classification Search
CPC ..... C22C 21/00; C22C 1/026; C22C 1/101; C22C 1/1084; C22C 1/1094; C22F 1/04
See application file for complete search history.

(56) References Cited

U.S. PATENT DOCUMENTS

2019/0032175 A1 1/2019 Martin et al.

FOREIGN PATENT DOCUMENTS

CN 104451227 A 3/2015
CN 109234562 A 1/2019
(Continued)

OTHER PUBLICATIONS

A.Radha, et al., An investigation of mechanical and wear properties of AA6061 reinforced with silicon carbide and graphene nano particles—Particulate composites, Materials Today: Proceedings, 2016, pp. 2247-2253, vol. 3.

*Primary Examiner* — Alexandra M Moore
(74) *Attorney, Agent, or Firm* — Bayramoglu Law Offices LLC

(57) ABSTRACT

A graphene and in-situ nano-$ZrB_2$ particle-co-reinforced aluminum matrix composite (AMC) and a preparation method thereof are provided. The preparation method includes: heating an aluminum alloy for melting, adding potassium fluoroborate and potassium fluorozirconate to produce $ZrB_2$ particles in-situ, additionally adding a mixture of pre-prepared copper-coated graphene and an aluminum powder, and stirring with an electromagnetic field for uniform dispersion; and ultrasonically treating the resulting melt to improve the dispersion of the in-situ nano-$ZrB_2$ particles and the graphene, casting for molding to obtain a
(Continued)

casting, and subjecting the casting to homogenization and rolling for deformation to obtain the graphene and in-situ nano-$ZrB_2$ particle-co-reinforced AMC. The in-situ generation of the reinforcement nano-$ZrB_2$ particles in an aluminum alloy melt increases the number of interfaces in the composite and also increases the dislocation density.

8 Claims, 1 Drawing Sheet

(51) Int. Cl.
*C22C 1/10* (2023.01)
*C22F 1/04* (2006.01)

(56) References Cited

FOREIGN PATENT DOCUMENTS

| | | | |
|---|---|---|---|
| CN | 110539002 | A | 12/2019 |
| CN | 110775960 | A | 2/2020 |
| CN | 111041297 | A | 4/2020 |
| CN | 111206166 | A | 5/2020 |
| CN | 111334689 | A | 6/2020 |
| CN | 111349830 | A | 6/2020 |
| CN | 112708804 | A | 4/2021 |
| GB | 2564261 | A | 1/2019 |

GRAPHENE- AND IN-SITU NANOPARTICLE-REINFORCED ALUMINUM-BASED COMPOSITE MATERIAL AND PREPARATION METHOD

CROSS REFERENCE TO THE RELATED APPLICATIONS

This application is the national phase entry of International Application No. PCT/CN2022/075973, filed on Feb. 11, 2022, which is based upon and claims priority to Chinese Patent Application No. 202011504174.3, filed on Dec. 18, 2020, the entire contents of which are incorporated herein by reference.

TECHNICAL FIELD

The present disclosure relates to a graphene and in-situ nano-$ZrB_2$ particle-co-reinforced aluminum matrix composite (AMC) and a preparation method thereof, and belongs to the technical field of preparation of graphene and particle-co-reinforced AMCs.

BACKGROUND

With the rapid development of modern industry, higher and higher requirements are put forward for the comprehensive performance of materials, especially composites with integrated structures and functions. Therefore, it is expected to produce materials with high strength and high rigidity and materials with excellent electrical and thermal conductivity, light weight, and prominent comprehensive performance.

In recent years, the research on graphene-reinforced AMCs has gradually started. According to reports, the addition of graphene to an aluminum matrix can improve the strength and hardness, and the resulting composite exhibits significantly-reduced plasticity and still needs to be further improved as a structural material.

Relevant studies have shown that in-situ nanoparticle-reinforced AMCs have high plasticity, and thus the in-situ nano-$ZrB_2$ particles are introduced through a melt in-situ reaction. Because there is a clean interface, prominent wettability, and high bonding strength between the in-situ nanoparticles and the aluminum matrix and the nanoparticles can increase the number of interfaces in the composite and increase the dislocation density, the stress concentration caused by graphene in the graphene-reinforced AMC is reduced, thereby improving the plasticity.

Graphene and in-situ nanoparticles are used as reinforcements and an aluminum alloy is used as a matrix to prepare an AMC, which can not only significantly increase a strength of the AMC while causing a small plasticity loss, but also provide high electrical and thermal conductivity for the AMC.

The performance of a graphene-reinforced AMC mainly depends on an interfacial bonding strength between a reinforcement graphene and a matrix. Graphene has poor interfacial wettability. In order to improve the wettability between graphene and an aluminum matrix, researchers propose surface modification for graphene, and the surface modification for graphene mainly includes plating or coating a metal on a surface of graphene, such as copper coating and nickel plating. In the present disclosure, copper is coated on a surface of graphene through a chemical reduction process, which leads to a uniform coating layer, does not require a DC power supply device, and can be widely used.

Currently, main methods for preparing graphene-reinforced AMCs include a melt stirring casting method, a powder metallurgy method, a pressure infiltration method, a friction stirring method, a laser melting method, or the like. Among the preparation methods, the melt stirring casting method for preparing graphene-reinforced AMCs is relatively mature, and can successfully add graphene with a complete crystal structure to an aluminum matrix. In combination with the copper coating on a surface of graphene to improve the interfacial wettability, the viscosity of a semi-solid aluminum melt during semi-solid forming (SSF), and the electromagnetic/ultrasonic stirring, the melt stirring casting method can theoretically achieve an expected effect. The powder metallurgy method, the pressure infiltration method, the friction stirring method, and the laser melting method involve complicated processes, and cannot prepare complicated large-sized components, which is not conducive to industrial production. Therefore, the present disclosure adopts the melt stirring casting method.

SUMMARY

The present disclosure is intended to provide a graphene and in-situ nano-$ZrB_2$ particle-co-reinforced AMC with high strength and high plasticity and a preparation method thereof. The in-situ generation of a reinforcement nano-$ZrB_2$ particles in an aluminum alloy melt increases the number of interfaces in the composite and also increases the dislocation density, thereby reducing the stress concentration caused by graphene in the graphene-reinforced AMC and effectively improving the plasticity of the graphene-reinforced AMC.

In a technical solution of the present disclosure, a preparation method of a graphene and in-situ nanoparticle-co-reinforced AMC is provided, including: heating an aluminum alloy for melting, adding potassium fluoroborate and potassium fluorozirconate to produce $ZrB_2$ particles in-situ, additionally adding a mixture of pre-prepared copper-coated graphene nanosheets and an aluminum powder, and stirring with an electromagnetic field for uniform dispersion to obtain a resulting melt; and ultrasonically treating the resulting melt to improve the dispersion of the in-situ nano-$ZrB_2$ particles and the graphene nanosheets, casting for molding to obtain a casting, and subjecting the casting to homogenization and rolling for deformation to obtain the graphene and in-situ nano-$ZrB_2$ particle-co-reinforced AMC, where the preparation method specifically includes the following steps:

(1) pretreatment of raw materials for producing the $ZrB_2$ particles: taking and thoroughly mixing the potassium fluoroborate and the potassium fluorozirconate according to a molar ratio of (2-2.1):1 to obtain a resulting mixture, and preheating the resulting mixture to 300° C. to 500° C. for later use;

(2) preparation of the copper-coated graphene through a chemical plating process: surface treatment of graphene: subjecting the graphene to ultrasonic dispersion in deionized water for 40 min to 60 min to obtain a 0.5 g/L to 3 g/L graphene dispersion, adding a reagent to the graphene dispersion to prepare a sensitizing solution, stirring the sensitizing solution for 40 min to 60 min to allow a sensitization treatment, filtering sensitized graphene out, and washing the sensitized graphene; adding the sensitized graphene to a 10 g/L $AgNO_3$ solution, slowly injecting aqueous ammonia until the solid is completely dissolved, stirring at room temperature for 40 min to 60 min to allow activation, filtering sensitized and activated graphene out, and washing the sensitized and activated graphene; adding the sensitized and activated graphene to a 15 g/L to 20 g/L sodium hypophosphite solution to obtain a resulting mixture, subjecting the resulting mixture to an ultrasonic treatment for 3 min to 5 min, and allowing the mixture to stand at room temperature for 1 min to 2 min to remove the residual activation solution on a surface of the graphene; and filtering the graphene out, rinsing the graphene with distilled water until neutral, and drying the graphene at 50° C. to 60° C. for later use; and subjecting the graphene obtained after the surface treatment to ultrasonic dispersion in deionized water for 3 min to 5 min to prepare a chemical plating solution; heating the chemical plating solution to 60° C. to 65° C., adding a formaldehyde solution to the chemical plating solution, and adding a NaOH solution dropwise to the chemical plating solution at a rate of 2 to 3 mL/3 min to maintain a pH of the chemical plating solution at 10 to 12, where the entire reduction process from the beginning of the dropwise addition of the NaOH solution to the end of the dropwise addition of the NaOH solution is controlled within 40 min to 50 min; filtering a product out, washing the product with pure water until neutral, and subjecting the product to passivation with a passivation solution for 10 min to 15 min; and washing a passivated product with absolute ethanol until neutral, and drying the passivated product to obtain the copper-coated graphene;

(3) mixing of the copper-coated graphene and the aluminum powder: mixing and ball-milling the copper-coated graphene and the aluminum powder for 1 h to 3 h in a ball mill under an Ar atmosphere according to a mass ratio of 1:(1-2) to obtain a mixture;

(4) preparation of an as-cast AMC: heating an aluminum alloy melt to 850° C. to 900° C., adding the pretreated potassium fluoroborate and potassium fluorozirconate to allow a reaction for 25 min to 30 min to produce the $ZrB_2$ particles, during which electromagnetic stirring (EMS) is conducted for particle dispersion; cooling to a predetermined temperature, and adding the mixture of the copper-coated graphene and the aluminum powder to the aluminum alloy melt under mechanical stirring to obtain a resulting mixture; and subjecting the resulting mixture to an ultrasonic treatment, and casting to obtain the as-cast AMC;

(5) homogenization: keeping the as-cast AMC at 560° C. for 20 h to 25 h; and (6) rolling: rolling a homogenized composite at 450° C. to 480° C. for deformation to finally obtain the graphene and in-situ nano-$ZrB_2$ particle-co-reinforced AMC.

In a technical solution of the present disclosure, in the graphene and in-situ nano-$ZrB_2$ particle-co-reinforced AMC, a content of the copper-coated graphene is 0.01 wt. % to 1 wt. %, a content of the $ZrB_2$ particles is 0.01 wt. % to 3 wt. %, and the balance is an AA6111 aluminum alloy.

In a technical solution of the present disclosure, the graphene is a graphene nanosheet with a thickness of 3 nm to 5 nm and a diameter of 5 μm to 20 μm.

In a technical solution of the present disclosure, in the step (2), components of the sensitizing solution include: $SnCl_2 \cdot 2H_2O$: 20 g/L to 30 g/L, and HCl: 0.5 mol/L to 0.6 mol/L.

In a technical solution of the present disclosure, in the step (2), a volume ratio of the $AgNO_3$ solution to the aqueous ammonia is 1,000:(12-15), and the aqueous ammonia has a concentration of 25 wt. %.

In a technical solution of the present disclosure, in the step (2), components of the chemical plating solution include: $CuSO_4 \cdot 5H_2O$: 15 g/L to 30 g/L, $C_4O_6H_4KNa$: 20 g/L to 40 g/L, and ethylenediaminetetraacetic acid disodium (EDTA-2Na): 25 g/L to 50 g/L.

In a technical solution of the present disclosure, in the step (2), the formaldehyde solution has a concentration of 37 wt. %, and is added to the chemical plating solution first at an amount of 1.5% to 2% of a volume fraction of the chemical plating solution to allow reduction for 2 min to 3 min and then at an amount of 3% to 4% of the volume fraction of the chemical plating solution.

In a technical solution of the present disclosure, in the step (2), the NaOH solution used for pH adjustment has a concentration of 37 wt. %.

In a technical solution of the present disclosure, in the step (2), the passivation solution is a solution of 0.5 wt. % to 1 wt. % benzotriazole in absolute ethanol.

In a technical solution of the present disclosure, in the step (3), the aluminum powder has a particle size of 10 μm to 20 μm, and the mixture of the copper-coated graphene and the aluminum powder is ball-milled at a rotational speed of 200 rpm to 300 rpm.

In a technical solution of the present disclosure, in the step (4), the cooling is conducted to 670° C. to 720° C.

In a technical solution of the present disclosure, in the step (4), the EMS is conducted at a frequency of 5 Hz to 20 Hz.

In a technical solution of the present disclosure, in the step (4), the mechanical stirring is conducted at a rotational speed of 1,000 rpm to 1,200 rpm for 5 min to 10 min.

In a technical solution of the present disclosure, in the step (4), the ultrasonic treatment before the casting is conducted at an ultrasonic power of 1 kW to 2 kW for 30 s to 60 s.

In a technical solution of the present disclosure, in the step (6), the rolling is conducted at a deformation amount of 50% to 95%.

Advantages and positive effects of the present disclosure: Since a graphene-reinforced AMC has high strength and insufficient plasticity and an in-situ nanoparticle-reinforced AMC has high plasticity and limited strength, graphene and in-situ nano-$ZrB_2$ particles are both added to an aluminum alloy to prepare an AMC with both high strength and high plasticity.

Because there is a clean interface, prominent wettability, and high bonding strength between the in-situ nanoparticles and the aluminum matrix and the nanoparticles can increase the number of interfaces in the composite and increase the dislocation density, the stress concentration caused by graphene is reduced and the plasticity of the composite is improved. The $ZrB_2$ particles are ceramic particles and thus can improve the strength as a second reinforcing phase. The dispersion of the nano-$ZrB_2$ particles and graphene nanosheets in the matrix can be improved by adjusting an electromagnetic/ultrasonic field to optimize a structure, such that the graphene and in-situ nano-$ZrB_2$ particle-co-reinforced AMC with high strength and high plasticity is obtained.

BRIEF DESCRIPTION OF THE DRAWINGS

FIG. 2A shows a surface parallel to a stress surface in a rolling direction (RD-TD surface) and FIG. 2B shows a surface parallel to a side surface in the rolling direction (RD-ND surface).

DETAILED DESCRIPTION OF THE EMBODIMENTS

Figure 1:
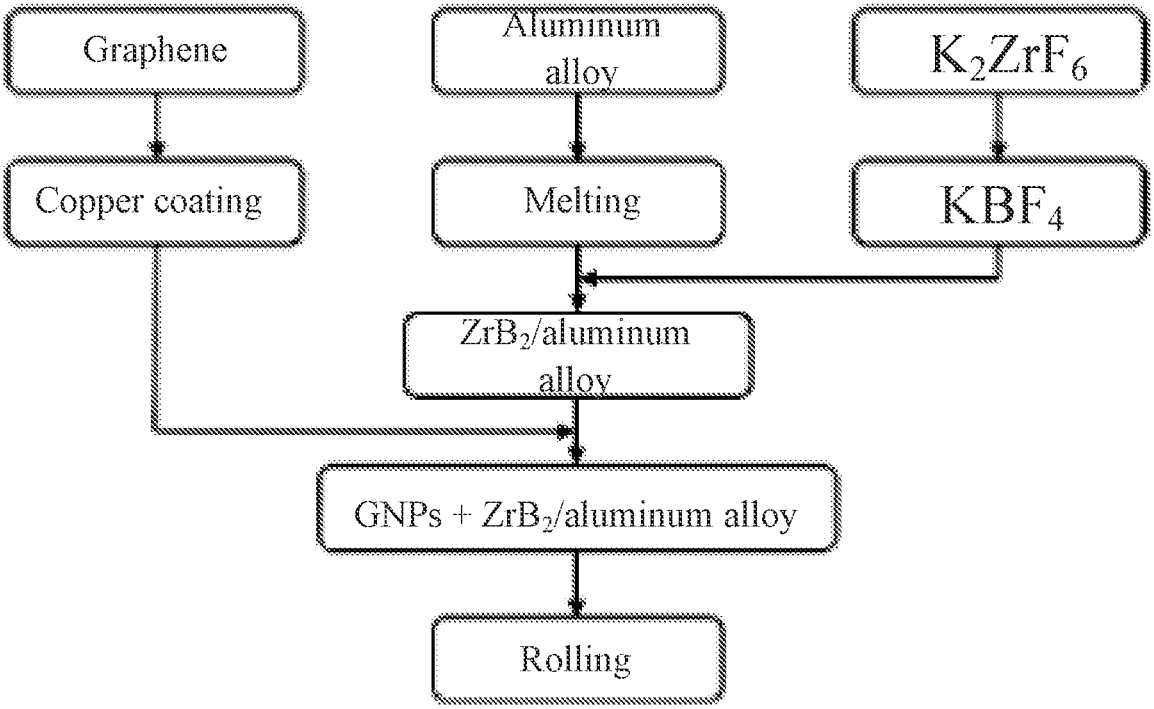
FIG. 1 is a schematic diagram of an experimental process of the present disclosure.

Example 1: A preparation method of an AMC co-reinforced with 0.01 wt. % graphene and 3 wt. % in-situ nano-$ZrB_2$ particles was provided in this example, which was as follows:

(1) Pretreatment of raw materials for producing the 3 wt. % $ZrB_2$ particles: 97.8 g of potassium fluoroborate and 91.2 g of potassium fluorozirconate were taken and thoroughly mixed, and then preheated to 300° C. for later use.

(2) Preparation of copper-coated graphene through a chemical plating process: surface treatment of graphene: 0.1 g of graphene was subjected to ultrasonic dispersion in 100 mL of deionized water for 50 min to obtain a 1 g/L graphene dispersion, a reagent was added to the graphene dispersion to prepare a sensitizing solution (3 g of $SnCl_2 \cdot 2H_2O$ and 5 mL of 37 wt. % HCl), and the sensitizing solution was stirred at 25° C. for 50 min to allow a sensitization treatment; sensitized graphene was filtered out, washed, and added to 100 mL of a 10 g/L $AgNO_3$ solution, 1.2 mL of aqueous ammonia was slowly injected until the solid was completely dissolved, and the resulting mixture was stirred at room temperature for 50 min to allow activation; sensitized and activated graphene was filtered out, washed, and added to a 20 g/L sodium hypophosphite solution, and the resulting mixture was subjected to an ultrasonic treatment for 3 min, and allowed to stand at room temperature for 1 min to remove the residual activation solution on a surface of the graphene; and the graphene was filtered out, rinsed with distilled water until neutral, and dried at 60° C. for later use; and the graphene obtained after the surface treatment was subjected to ultrasonic dispersion in 100 mL of deionized water for 3 min, and a chemical reagent was added to prepare a chemical plating solution (1.5 g of $CuSO_4 \cdot 5H_2O$, 2 g of $C_4O_6H_4KNa$, and 2.5 g of EDTA-2Na); the chemical plating solution was heated to 60° C., 1.5 mL of a formaldehyde solution was added dropwise to the chemical plating solution to allow reduction for 3 min, and then 3 mL of the formaldehyde solution was added, during which a 37 wt. % NaOH solution was added dropwise to the chemical plating solution at a rate of 2 mL/3 min to maintain a pH of the chemical plating solution at 11.5 to 12, where the entire reduction process from the beginning of the dropwise addition of the NaOH solution to the end of the dropwise addition of the NaOH solution was controlled within 40 min; a product was filtered out, washed with pure water until neutral, and subjected to passivation with a passivation solution for 15 min; and a passivated product was washed with absolute ethanol until neutral, and then dried to obtain a copper-coated graphene nanosheet.

(3) Mixing of the copper-coated graphene and an aluminum powder: 0.8 g of the copper-coated graphene and 1.6 g of the aluminum powder with a particle size of 20 μm were mixed and ball-milled for 1 h in a ball mill under an Ar atmosphere at a rotational speed of 200 rpm to obtain a mixture.

(4) Preparation of an as-cast AMC: 970 g of an AA6111 aluminum alloy melt was heated to 850° C., the pretreated potassium fluoroborate and potassium fluorozirconate were added to allow a reaction for 25 min to produce $ZrB_2$ particles, during which EMS was conducted at 10 Hz for particle dispersion; the resulting reaction system was cooled to 700° C., and the mixture of the copper-coated graphene and the aluminum powder was added to the aluminum alloy melt under mechanical stirring at 1,000 rpm for 5 min; and the resulting mixture was heated to 720° C., then subjected to an ultrasonic treatment at 1.5 kW for 50 s, and casted to obtain the as-cast AMC.

(5) Homogenization: The as-cast AMC was kept at 560° C. for 20 h.

(6) Rolling: A homogenized composite was rolled at 450° C. with a deformation amount of 84% to finally obtain the graphene and in-situ nano-$ZrB_2$ particle-co-reinforced AMC.

The AMC co-reinforced with 0.01 wt. % graphene and 3 wt. % in-situ nano-$ZrB_2$ particles prepared in this example had a strength of 372 MPa and an elongation of 25%.

Example 2: A preparation method of an AMC co-reinforced with 0.1 wt. % graphene and 0.1 wt. % in-situ nano-$ZrB_2$ particles was provided in this example, which was as follows:

(1) Pretreatment of raw materials for producing the 0.1 wt. % $ZrB_2$ particles: 3.3 g of potassium fluoroborate and 3.0 g of potassium fluorozirconate were taken and thoroughly mixed, and then preheated to 300° C. for later use.

(2) Preparation of copper-coated graphene through a chemical plating process: surface treatment of graphene: 1 g of graphene was subjected to ultrasonic dispersion in 1 L of deionized water for 50 min to obtain a 1 g/L graphene dispersion, a reagent was added to the graphene dispersion to prepare a sensitizing solution (30 g of $SnCl_2 \cdot 2H_2O$ and 50 mL of 37 wt. % HCl), and the sensitizing solution was stirred at 25° C. for 50 min to allow a sensitization treatment; sensitized graphene was filtered out, washed, and added to 1 L of a 10 g/L $AgNO_3$ solution, 12 mL of aqueous ammonia was slowly injected until the solid was completely dissolved, and the resulting mixture was stirred at room temperature for 50 min to allow activation; sensitized and activated graphene was filtered out, washed, and added to a 20 g/L sodium hypophosphite solution, and the resulting mixture was subjected to an ultrasonic treatment for 3 min, and allowed to stand at room temperature for 1 min to remove the residual activation solution on a surface of the graphene; and the graphene was filtered out, rinsed with distilled water until neutral, and dried at 60° C. for later use; and the graphene obtained after the surface treatment was subjected to ultrasonic dispersion in 1 L of deionized water for 3 min, and a chemical reagent was added to prepare a chemical plating solution (15 g of $CuSO_4 \cdot 5H_2O$, 20 g of $C_4O_6H_4KNa$, and 25 g of EDTA-2Na); the chemical plating solution was heated to 60° C., 15 mL of a formaldehyde solution was added dropwise to the chemical plating solution to allow reduction for 3 min, and then 30 mL of the formaldehyde solution was added, during which a 37 wt. % NaOH solution was added dropwise to the chemical plating solution at a rate of 2 mL/3 min to maintain a pH of the chemical plating solution at 11.5 to 12, where the entire reduction process from the beginning of the dropwise addition of the NaOH solution to the end of the dropwise addition of the NaOH solution was controlled within 40 min; a product was filtered out, washed with pure water until neutral, and subjected to passivation with a passivation solution for 15 min; and a passivated product was washed with absolute ethanol until neutral, and then dried to obtain a copper-coated graphene nanosheet.

(3) Mixing of the copper-coated graphene and an aluminum powder: 8 g of the copper-coated graphene and 16 g of the aluminum powder with a particle size of 20 μm were mixed and ball-milled for 1 h in a ball mill under an Ar atmosphere at a rotational speed of 200 rpm to obtain a mixture.

(4) Preparation of an as-cast AMC: 970 g of an AA6111 aluminum alloy melt was heated to 700° C., the mixture of the copper-coated graphene and the aluminum powder was added to the aluminum alloy melt under mechanical stirring at 1,000 rpm for 5 min, and the resulting mixture was heated to 720° C., then subjected to an ultrasonic treatment at 1.5 kW for 50 s, and casted to obtain the as-cast AMC.

(5) Homogenization: The as-cast AMC was kept at 560° C. for 20 h.

(6) Rolling: A homogenized composite was rolled at 450° C. with a deformation amount of 84% to finally obtain the graphene and in-situ nano-$ZrB_2$ particle-co-reinforced AMC.

The AMC co-reinforced with 0.1 wt. % graphene and 0.1 wt. % in-situ nano-$ZrB_2$ particles prepared in this example had a strength of 427 MPa and an elongation of 16%, where the strength was increased by 14.8% and the elongation was reduced by 36% compared with the AMC co-reinforced with 0.01 wt. % graphene and 3 wt. % in-situ nano-$ZrB_2$ particles prepared in Example 1.

Example 3: A preparation method of an AMC co-reinforced with 0.1 wt. % graphene and 3 wt. % in-situ nano-$ZrB_2$ particles was provided in this example, which was as follows:

(1) Pretreatment of raw materials for producing the 3 wt. % $ZrB_2$ particles: 97.8 g of potassium fluoroborate and 91.2 g of potassium fluorozirconate were taken and thoroughly mixed, and then preheated to 300° C. for later use.

(2) Preparation of copper-coated graphene through a chemical plating process: surface treatment of graphene: 1 g of graphene was subjected to ultrasonic dispersion in 1 L of deionized water for 50 min to obtain a 1 g/L graphene dispersion, a reagent was added to the graphene dispersion to prepare a sensitizing solution (30 g of $SnCl_2 \cdot 2H_2O$ and 50 mL of 37 wt. % HCl), and the sensitizing solution was stirred at 25° C. for 50 min to allow a sensitization treatment; sensitized graphene was filtered out, washed, and added to 1 L of a 10 g/L $AgNO_3$ solution, 12 mL of aqueous ammonia was slowly injected until the solid was completely dissolved, and the resulting mixture was stirred at room temperature for 50 min to allow activation; sensitized and activated graphene was filtered out, washed, and added to a 20 g/L sodium hypophosphite solution, and the resulting mixture was subjected to an ultrasonic treatment for 3 min, and allowed to stand at room temperature for 1 min to remove the residual activation solution on a surface of the graphene; and the graphene was filtered out, rinsed with distilled water until neutral, and dried at 60° C. for later use; and the graphene obtained after the surface treatment was subjected to ultrasonic dispersion in 1 L of deionized water for 3 min, and a chemical reagent was added to prepare a chemical plating solution (15 g of $CuSO_4 \cdot 5H_2O$, 20 g of $C_4O_6H_4Kna$, and 25 g of EDTA-2Na); the chemical plating solution was heated to 60° C., 15 mL of a formaldehyde solution was added dropwise to the chemical plating solution to allow reduction for 3 min, and then 30 mL of the formaldehyde solution was added, during which a 37 wt. % NaOH solution was added dropwise to the chemical plating solution at a rate of 2 mL/3 min to maintain a pH of the chemical plating solution at 11.5 to 12, where the entire reduction process from the beginning of the dropwise addition of the NaOH solution to the end of the dropwise addition of the NaOH solution was controlled within 40 min; a product was filtered out, washed with pure water until neutral, and subjected to passivation with a passivation solution for 15 min; and a passivated product was washed with absolute ethanol until neutral, and then dried to obtain a copper-coated graphene nanosheet.

(3) Mixing of the copper-coated graphene and an aluminum powder: 8 g of the copper-coated graphene and 16 g of the aluminum powder with a particle size of 20 μm were mixed and ball-milled for 1 h in a ball mill under an Ar atmosphere at a rotational speed of 200 rpm to obtain a mixture.

(4) Preparation of an as-cast AMC: 970 g of an AA6111 aluminum alloy melt was heated to 850° C., the pretreated potassium fluoroborate and potassium fluorozirconate were added to allow a reaction for 25 min to produce $ZrB_2$ particles, during which EMS was conducted at 10 Hz for particle dispersion; the resulting reaction system was cooled to 700° C., and the mixture of the copper-coated graphene and the aluminum powder was added to the aluminum alloy melt under mechanical stirring at 1,000 rpm for 5 min; and the resulting mixture was heated to 720° C., then subjected to an ultrasonic treatment at 1.5 kW for 50 s, and casted to obtain the as-cast AMC.

(5) Homogenization: The as-cast AMC was kept at 560° C. for 20 h.

(6) Rolling: A homogenized composite was rolled at 450° C. with a deformation amount of 84% to finally obtain the graphene and in-situ nano-$ZrB_2$ particle-co-reinforced AMC.

The AMC co-reinforced with 0.1 wt. % graphene and 3 wt. % in-situ nano-$ZrB_2$ particles prepared in this example had a strength of 474 MPa and an elongation of 15%, where the strength was increased by 27.4% and the elongation was reduced by 40% compared with the AMC co-reinforced with 0.01 wt. % graphene and 3 wt. % in-situ nano-$ZrB_2$ particles prepared in Example 1; and the strength was increased by 11% and the elongation was reduced by 6.7% compared with the AMC co-reinforced with 0.1 wt. % graphene and 0.1 wt. % in-situ nano-$ZrB_2$ particles prepared in Example 2.

Figures 2A, 2B:
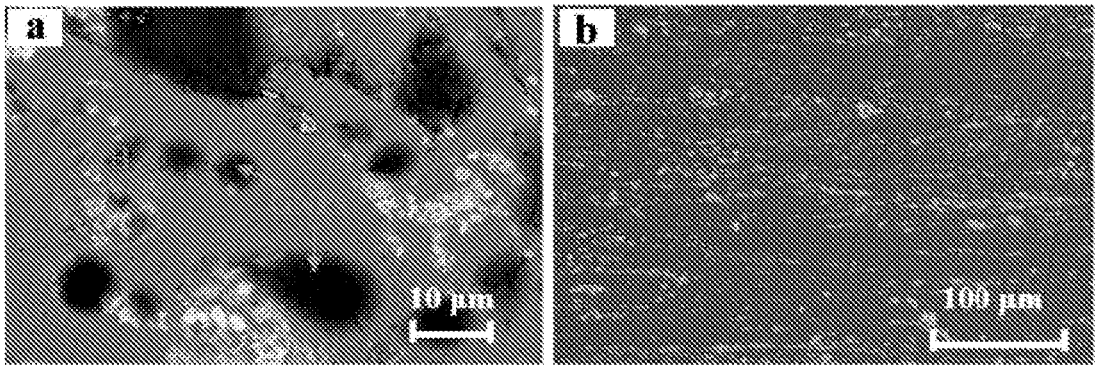
FIGS. 2A-2B show scanning patterns of a microstructure in a rolling state, where

FIGS. 2A-2B show scanning patterns of a microstructure in a rolling state, where FIG. 2A shows a surface parallel to a stress surface in a rolling direction (RD-TD surface) and FIG. 2B shows a surface parallel to a side surface in the rolling direction (RD-ND surface). It can be seen from the figure that the graphene and in-situ nano-$ZrB_2$ particles coexist in the aluminum matrix. The AMC co-reinforced with 0.1 wt. % graphene and 3 wt. % in-situ nano-$ZrB_2$ particles prepared in this example has high strength and high plasticity.

What is claimed is:

1. A preparation method of a graphene and in-situ nanoparticle-co-reinforced aluminum matrix composite, comprising: heating an aluminum alloy for melting, adding potassium fluoroborate and potassium fluorozirconate to produce in-situ nano-$ZrB_2$ particles, additionally adding a mixture of pre-prepared copper-coated graphene nanosheets and an aluminum powder, followed by stirring with an electromagnetic field for an uniform dispersion to obtain a resulting melt; and ultrasonically treating the resulting melt to improve a dispersion of the in-situ nano-$ZrB_2$ particles and the pre-prepared copper-coated graphene nanosheets, followed by casting for molding to obtain a casting, and subjecting the casting to homogenization and rolling for a deformation to obtain a graphene and in-situ nano-$ZrB_2$ particle-co-reinforced aluminum matrix composite, wherein the preparation method specifically comprises the following steps:

(1) a pretreatment of raw materials for producing the nano-$ZrB_2$ particles: taking and thoroughly mixing the potassium fluoroborate and the potassium fluorozirconate according to a molar ratio of (2-2.1):1 to obtain a first resulting mixture, and preheating the first resulting mixture to 300° C. to 500° C. for later use;

(2) a preparation of the pre-prepared copper-coated graphene;

(3) a mixing of copper-coated graphene and the aluminum powder: mixing and ball-milling the copper-coated graphene and the aluminum powder for 1 h to 3 h in a ball mill under an Ar atmosphere according to a mass ratio of 1:(1-2) to obtain a mixture;

(4) a preparation of an as-cast aluminum matrix composite: heating an aluminum alloy melt to 850° C. to 900° C., adding pretreated potassium fluoroborate and potassium fluorozirconate to allow a reaction for 25 min to 30 min to produce the nano-$ZrB_2$ particles, during the reaction, an electromagnetic stirring is conducted for a particle dispersion; cooling to a predetermined temperature, and adding the mixture of the copper-coated graphene and the aluminum powder to the aluminum alloy melt under a mechanical stirring to obtain a second resulting mixture; and subjecting the second resulting mixture to an ultrasonic treatment, and casting to obtain the as-cast aluminum matrix composite;

(5) a homogenization: keeping the as-cast aluminum matrix composite at 560° C. for 20 h to 25 h; and (6) a rolling: rolling a homogenized composite at 450° C. to 480° C. for the deformation to finally obtain the graphene and in-situ nano-$ZrB_2$ particle-co-reinforced aluminum matrix composite;

wherein in the graphene and in-situ nano-$ZrB_2$ particle-co-reinforced aluminum matrix composite, a content of the copper-coated graphene is 0.01 wt. % to 1 wt. %, a content of the nano-$ZrB_2$ particles is 0.01 wt. % to 3 wt. %, and the balance is an AA6111 aluminum alloy.

2. The preparation method of the graphene and in-situ nanoparticle-co-reinforced aluminum matrix composite according to claim 1, wherein the copper-coated graphene is prepared through a chemical plating process; and the chemical plating process comprises the following steps: a surface treatment of graphene: subjecting the graphene to an ultrasonic dispersion in deionized water for 40 min to 60 min to obtain a 0.5 g/L to 3 g/L graphene dispersion, adding a reagent to the 0.5 g/L to 3 g/L graphene dispersion to prepare a sensitizing solution, stirring the sensitizing solution for 40 min to 60 min to allow a sensitization treatment, filtering sensitized graphene out, and washing the sensitized graphene; adding the sensitized graphene to a 10 g/L $AgNO_3$ solution, slowly injecting an aqueous ammonia until a solid is completely dissolved, stirring at room temperature for 40 min to 60 min to allow an activation, filtering sensitized and activated graphene out, and washing the sensitized and activated graphene; adding the sensitized and activated graphene to a 15 g/L to 20 g/L sodium hypophosphite solution to obtain a third resulting mixture, subjecting the third resulting mixture to an ultrasonic treatment for 3 min to 5 min, and allowing the third resulting mixture to stand at room temperature for 1 min to 2 min to remove a residual activation solution on a surface of the graphene; and filtering the graphene out, rinsing the graphene with distilled water until neutral, and drying the graphene at 50° C. to 60° C. for later use; and subjecting the graphene obtained after the surface treatment to the ultrasonic dispersion in deionized water for 3 min to 5 min to prepare a chemical plating solution; heating the chemical plating solution to 60° C. to 65° C., adding a formaldehyde solution to the chemical plating solution, and adding a NaOH solution dropwise to the chemical plating solution at a rate of 2 to 3 mL/3 min to maintain a pH of the chemical plating solution at 10 to 12, wherein an entire reduction process from a beginning of a dropwise addition of the NaOH solution to an end of the dropwise addition of the NaOH solution is controlled within 40 min to 50 min; filtering a product out, washing the product with pure water until neutral, and subjecting the product to a passivation with a passivation solution for 10 min to 15 min; and washing a passivated product with absolute ethanol until neutral, and drying the passivated product to obtain the copper-coated graphene.

3. The preparation method of the graphene and in-situ nanoparticle-co-reinforced aluminum matrix composite according to claim 2, wherein the graphene is a graphene nanosheet with a thickness of 3 nm to 5 nm and a diameter of 5 μm to 20 μm.

4. The preparation method of the graphene and in-situ nanoparticle-co-reinforced aluminum matrix composite according to claim 2, wherein the sensitizing solution comprises: $SnCl_2 \cdot 2H_2O$: 20 g/L to 30 g/L, and HCl: 0.5 mol/L to 0.6 mol/L; a volume ratio of the $AgNO_3$ solution to the aqueous ammonia is 1,000:(12-15), and the aqueous ammonia has a concentration of 25 wt. %; and the chemical plating solution comprises: $CuSO_4 \cdot 5H_2O$: 15 g/L to 30 g/L, $C_4O_6H_4KNa$: 20 g/L to 40 g/L, and ethylenediaminetetraacetic acid disodium (EDTA-2Na): 25 g/L to 50 g/L.

5. The preparation method of the graphene and in-situ nanoparticle-co-reinforced aluminum matrix composite according to claim 2, wherein the formaldehyde solution has a concentration of 37 wt. % and is added to the chemical plating solution first at an amount of 1.5% to 2% of a volume fraction of the chemical plating solution to allow a reduction for 2 min to 3 min and then at an amount of 3% to 4% of the volume fraction of the chemical plating solution; the NaOH solution used for a pH adjustment has a concentration of 37 wt. %; and the passivation solution is a solution of 0.5 wt. % to 1 wt. % benzotriazole in absolute ethanol.

6. The preparation method of the graphene and in-situ nanoparticle-co-reinforced aluminum matrix composite according to claim 1, wherein in the step (3), the aluminum powder has a particle size of 10 μm to 20 μm, and the mixture of the copper-coated graphene and the aluminum powder is ball-milled at a rotational speed of 200 rpm to 300 rpm.

7. The preparation method of the graphene and in-situ nanoparticle-co-reinforced aluminum matrix composite according to claim 1, wherein in the step (4), the cooling is conducted to 670° C. to 720° C.; the electromagnetic stirring is conducted at a frequency of 5 Hz to 20 Hz; the mechanical stirring is conducted at a rotational speed of 1,000 rpm to 1,200 rpm for 5 min to 10 min; and the ultrasonic treatment before the casting is conducted at an ultrasonic power of 1 kW to 2 kW for 30 s to 60 s.

8. The preparation method of the graphene and in-situ nanoparticle-co-reinforced aluminum matrix composite according to claim 1, wherein in the step (6), the rolling is conducted at a deformation amount of 50% to 95%.

* * * * *